United States Patent [19]

Arbizzani

[11] Patent Number: 4,840,065

[45] Date of Patent: Jun. 20, 1989

[54] DRIED LOAD DETECTOR FOR DRY-CLEANING MACHINES

[75] Inventor: Tommaso Arbizzani, Pontecchio Marconi, Italy

[73] Assignee: Sodibo S.p.A., Bologna, Italy

[21] Appl. No.: 99,357

[22] Filed: Sep. 21, 1987

[30] Foreign Application Priority Data

Sep. 30, 1986 [IT] Italy ..... 3529 A/86

[51] Int. Cl.[4] ..... G01F 23/24

[52] U.S. Cl. ..... 73/295; 68/18 R

[58] Field of Search ..... 73/304 R, 295, 865.9; 340/620, 622; 68/12 FA, 18 R; 137/387, 380

[56] References Cited

U.S. PATENT DOCUMENTS

| | | | |
|---|---|---|---|
| 3,184,932 | 5/1965 | Cobb | 68/12 FA |
| 3,270,530 | 9/1966 | Czech | 68/18 R |
| 3,966,602 | 6/1976 | Burger | 68/18 R |
| 4,086,705 | 5/1978 | Wehr | 68/18 R |
| 4,111,034 | 9/1978 | Hubner | 68/13 R |
| 4,449,404 | 5/1984 | Bohme | 73/295 |
| 4,564,834 | 1/1986 | Steele | 73/295 |
| 4,637,232 | 1/1987 | Zucchini | 68/18 R |

*Primary Examiner*—Stewart J. Levy
*Assistant Examiner*—Robert P. Bell
*Attorney, Agent, or Firm*—Guido Modiano; Albert Josif

[57] ABSTRACT

Dried load detector, for dry-cleaning machines, adapted to be arranged on the duct connecting a steam condensing assembly to a separator of the solvent and the water contained in the steam. The dried load detector is constituted by a case having an inlet conduit and an outlet conduit and defining at least one inlet chamber and one outlet chamber separated by a partition having a solvent aperture and a water aperture located at different heights. A solvent level detector is provided between the solvent aperture and the outlet conduit.

6 Claims, 2 Drawing Sheets

DRIED LOAD DETECTOR FOR DRY-CLEANING MACHINES

BACKGROUND OF THE INVENTION

The present invention relates to a dried load detector for dry-cleaning machines.

The steps of drying and deodorization in the washing cycles of dry-cleaning machines are currently controlled in an improper manner: in practice, a standard drying time is preset, at the end of which the machine stops; or, the amount of mixture (solvent and water) recovered in the drying step is measured and the drying is stopped when the solvent-water amount is smaller than a preset value.

While with the first system it is obvious that the results obtained are extremely variable with respect to one another, the second system is affected by a basic flaw, which resides in the fact that the degree of drying of the load is evaluated by measuring, in practice, also the amount of water present in the mixture, while it is the solvent that causes trouble and must be eliminated; in fact, while the solvent remaining in the clothes is undesirable (it leaves foul odors in them), a little water is instead useful in order to facilitate, for example, the subsequent ironing operations.

SUMMARY OF THE INVENTION

The technical aim of the present invention is to eliminate the above described disadvantages of the prior art, that is to say, to provide a dried load indicator which is capable of detecting the presence of solvent and of intervening when the value of the solvent present has reached preset values.

Within the scope of this aim, an object of the invention is to provide a detector with a simple structure which is relatively easy to manufacture in practice, is safe in use and effective in operation, and also has a relatively modest cost.

This aim and these objects are achieved by a dried load detector, particularly for dry-cleaning machines comprising a case arranged on a duct connecting a steam condensing assembly to a separator, said steam being essentially composed of water and a solvent, characterized in that said case comprises an inlet conduit and an outlet conduit and defines at least one inlet chamber and one outlet chamber separated by a partition, said partition comprising a solvent aperture and a water aperture located at different heights and connecting said inlet chamber to said outlet conduit, a solvent level detector being provided between said solvent aperture and said outlet conduit.

BRIEF DESCRIPTION OF THE DRAWINGS

Further characteristics will become apparent and evident from the detailed description of a preferred, but not exclusive, embodiment of a detector according to the invention, illustrated only by way of non-limitative example in the accompanying drawings, wherein.

DESCRIPTION OF THE PREFERRED EMBODIMENTS

Figure 2:
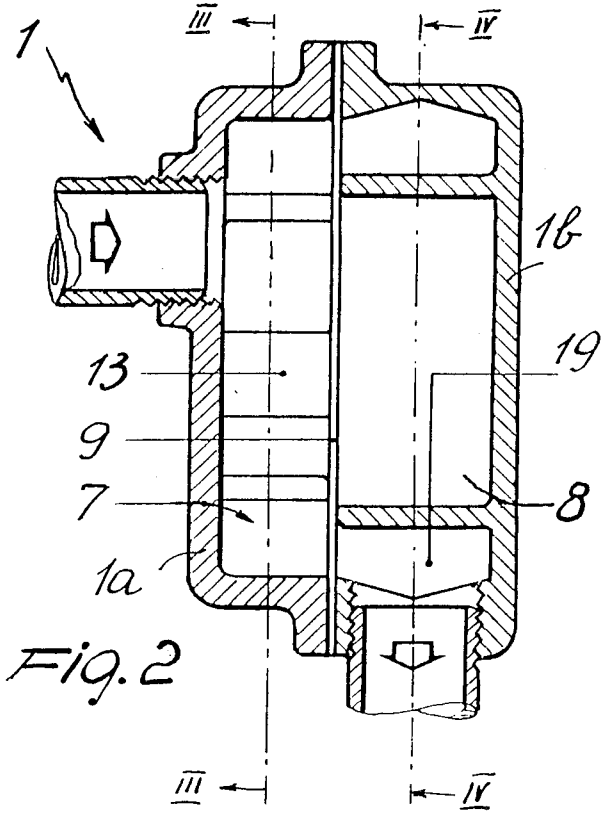
FIG. 2 is a lateral cross section view of a dried load detector according to the invention.

With particular reference to the above described figures, the detector according to the invention is generally indicated by the reference numeral 1, and is applied to a dry-cleaning machine indicated by 2.

Of said dry-cleaning machine 2, the drawings illustrate schematically the assembly 3 for the condensation of the vapor exiting from the drum 4 and a separator 5 for separating the condensed solvent from the condensed water: the numeral 6 indicates the duct which connects the assembly 3 to the separator 5; the detector 1 is arranged on the duct 6.

The detector 1 is composed (FIG. 2) of a two piece case 1*a*, 1*b* defining an inlet chamber 7 and an outlet chamber 8.

Figure 4:
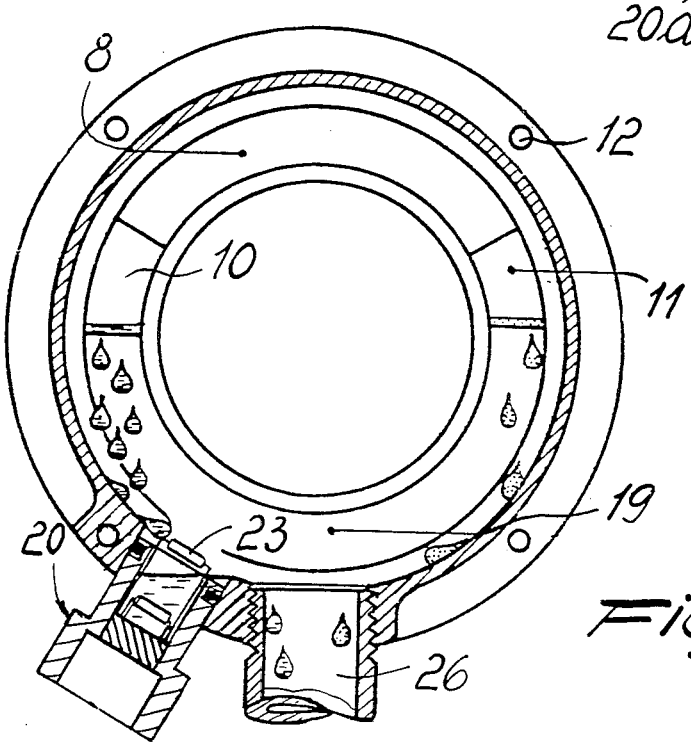

The two chambers 7 and 8 are separated by a partition 9 provided with two openings 10 and 11 (FIG. 4). The case's two pieces 1*a*, 1*b* and the partition 9 are joined to one another by means of screws or tensioning elements 12 (FIG. 4).

Figure 1:
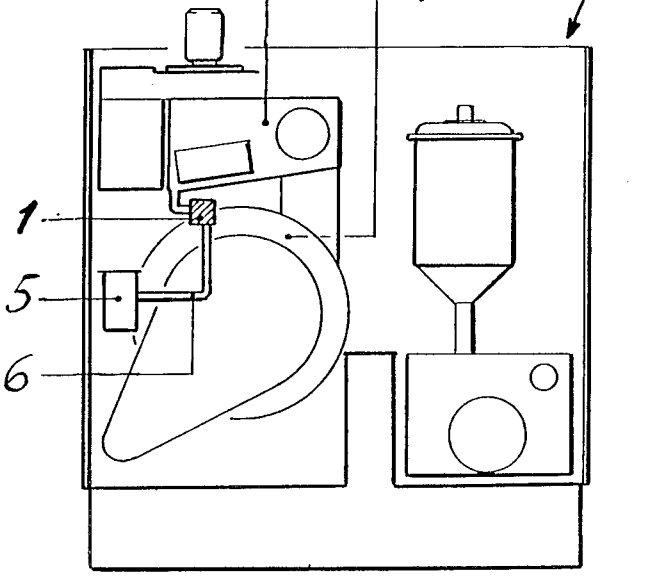
FIG. 1 is a schematic view of a dry-cleaning machine fitted with a dried load detector according to the invention.

The mixture of solvent and water, coming from the assembly 3, (FIG. 1) enters through the inlet tube into the inner chamber 13 of the inlet chamber 7.

Figure 3:
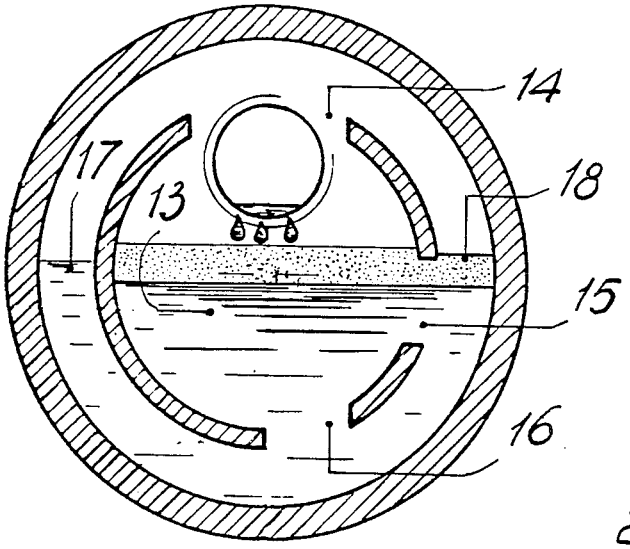
FIGS. 3 and 4 are cross section views of FIG. 2 along the planes A—A and B—B.

FIG. 3 illustrates the partitioning of the inner chamber 13 from a peripheral chamber by means of a ring provided with three openings: an upper one 14, a lateral one 15, and a lower one 16.

The mixture of water and solvent entering the inner chamber 13 is separated (the water being indicated by the dotted region, the solvent by the horizontally shaded region) because of their different specific weight. The solvent, flowing through the opening 16, thus rises along the channel 17 until it reaches the opening 10 of the partition 9 (FIG. 4). Similarly, the separated water flows through the lateral opening 15 up to the contact region 18, where it is at the level of the opening 11 of the partition 9.

In this matter, the water and the solvent fall into the annular chamber 19 of the chamber 8 and then reach the discharge conduit 26.

During its flow inside the chamber 19 between the opening 10 and the discharge conduit 26, the solvent strikes the sensor element 23 of a plug 20.

Figure 5:
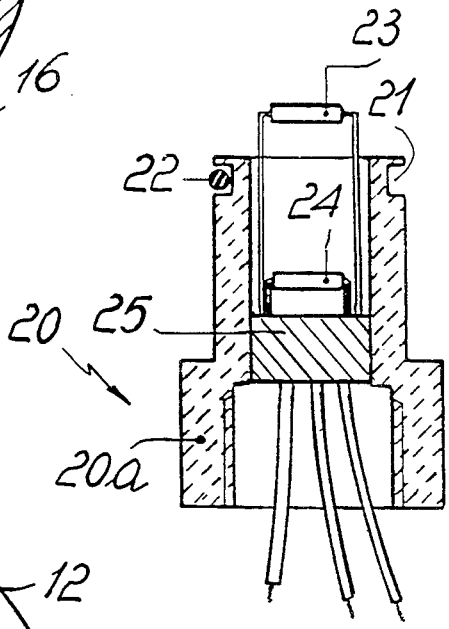
FIG. 5 is an enlarged section view of a detail of the detector.

The plug 20 (FIG. 5), inserted in a hole connected to the outlet chamber 8 immediately upstream with respect to the discharge conduit 26, consists of a body 20a which is provided with a recess 21 housing a sealing ring 22, a seal 25 and two resistors 23 and 24, variable according to the dissipated power (NTC type) and arranged at different heights: the resistor 23 protruding from the body 20a, the resistor 24 being inside the body 20a.

The resistors 23 and 24 are powered by an external electronic circuit of a known type, not shown in the drawings, which constantly measurer the value of the resistance of both resistors 23 and 24.

The resistor 24 is always immersed in the solvent: it dissipates therefore an always constant power which can thus be used as reference.

The resistor 23 is in such a position that at the beginning of the drying phase, that is to say with large amounts of recovered solvent, it is immersed. In such a condition, the resistor 23 dissipates an amount of power equal to that dissipated by 24. As the drying of the clothes proceeds, and therefore as the amount of recovered solvent gradually decreases, the resistor 23 gradually emerges; accordingly the value of the power dissipated by the resistor 23 also gradually varies.

An adapted comparator circuit continuously compares the difference between the two dissipated power values: naturally said difference will be=0 for considerable amounts of solvent recovery, subsequently increasing as the recovery amount decreases. When a preset value of difference, corresponding to the complete lack of flow of recovered solvent is reached (the resistor 23 in such a condition being completely uncovered), the comparator circuit provides to stop the drying action. The comparator circuit is of a known type and is not shown here.

By varying the position of the resistors, the amplification coefficient and the response times of the circuits and the size of the openings of the partitions, it is possible to define as required the time of response according to the value of the flow-rate of the water and solvent.

The fact is stressed that with the detector according to the invention the presence of solvent is determined regardless of the water, and that this is exactly what is required for the halting of the drying phase at the right moment.

It has thus been observed that the invention achieves the intended aim and objects.

The invention thus conceived is susceptible to numerous modifications and variations, all of which are within the scope of the inventive concept.

Moreover, all the details may be replaced with other technically equivalent ones.

In practice, the materials employed, as well as the shapes and the dimensions, may be any according to the requirements.

I claim:

1. Dried load detector for dry-cleaning machines comprising a case arranged on a duct connecting a vapor condensing assembly to a separator, said vapor being essentially composed of water and a solvent, said case comprising an inlet conduit and an outlet conduit and defining at least one inlet chamber and one outlet chamber separated by a partition, said partition comprising a solvent aperture and a water aperture located at different heights and connecting said inlet chamber to said outlet conduit, a solvent level detector being provided between said solvent aperture and said outlet conduit whereby a load dryness is detected as a function of the solvent level.

2. Dried load detector, according to claim 1, wherein said solvent level detector comprises a first resistor and a second resistor located below said first resistor, said second resistor being constantly immersed in said solvent, wherein said resistors have variable resistance according to the dissipated power, said resistors being connected to a circuit adapted to detect the difference of dissipated power between said first and second resistors whereby the solvent level is detected as a function of the difference in the dissipated power between said first and second resistors.

3. Dried load detector, according to claim 2, wherein said resistors are associated to a plug removably associated to said case.

4. Dried load detector, according to claim 1, wherein said case is composed of a first piece associated to a second piece which respectively define said inlet chamber and said outlet chamber, said partition being interposed between said first and second pieces.

5. Dried load detector, according to claim 1, wherein said inlet chamber comprises an inner chamber surrounded by a peripheral chamber and connected to said peripheral chamber by means of an upper opening, a lateral opening and a lower opening.

6. Dried load detector, according to claim 1, wherein said outlet chamber comprises an annular chamber connecting said solvent aperture and said water aperture to said outlet conduit.

* * * * *